United States Patent [19]

Jones

[11] Patent Number: 4,737,608

[45] Date of Patent: Apr. 12, 1988

[54] CONVERTIBLE ROTARY SWITCH

[75] Inventor: John C. Jones, Chicago, Ill.

[73] Assignee: Illinois Tool Works Inc., Chicago, Ill.

[21] Appl. No.: 72,100

[22] Filed: Jul. 10, 1987

[51] Int. Cl.[4] ..... H01H 19/02

[52] U.S. Cl. ..... 200/155 R; 200/300; 200/336

[58] Field of Search ..... 200/155 R, 336, 300, 200/43.08

[56] References Cited

U.S. PATENT DOCUMENTS 2,370,519 2/1945 Bolesky ..... 200/155 R 3,519,777 7/1970 Kaiser ..... 200/155 R

*Primary Examiner*—Renee S. Luebke

*Attorney, Agent, or Firm*—D. J. Breh; T. W. Buckman

[57] ABSTRACT

A rotary switch convertible from being operable over a smaller range of angular motion, e.g. as a two-position switch, into being operable, in either of two configurations, over larger ranges of angular motion, e.g. as a three-position switch. A rotor and a stator are assembled for relative rotation. Four lugs divide a face of the stator into four quadrants. Two pairs of lugs, each comprising a removable lug and a permanent lug, are provided on a face of the rotor. The faces are juxtaposed such that relative rotation of the rotor and the stator is limited by interference between certain of the lugs on the rotor and certain of the lugs on the stator. Before removal of either removable lug, the rotor and the stator may be assembled for a smaller range of angular motion. After removal of both removable lugs, the rotor and the stator may be assembled in either of two configurations for larger ranges of angular motion.

11 Claims, 3 Drawing Sheets

CONVERTIBLE ROTARY SWITCH

BACKGROUND OF THE INVENTION

This invention pertains to a rotary switch of a type which is convertible from a configuration operable over a smaller range of annular motion, such as a two-position switch, into a configuration operable over larger ranges of angular motion, such as a three-position switch.

Typically, such a switch comprises a rotor and a stator, which can be selectively assembled in either configuration. U.S. Pat. No. 3,167,620 and U.S. Pat. No. 3,363,070 disclosed specific examples of such a switch, in which 90° inversion of the rotor converts the switch from a first configuration to a second configuration, e.g. from a two-position switch to a three-position switch, and vice versa. As disclosed in these patents, it is known for stops formed on or in the rotor and stops formed on or in the stator to limit relative rotation of the rotor and the stator in each configuration. Each of the switches disclosed in those patents can be selectively configured in either of two but only two configurations.

A variation in such a switch is disclosed in U.S. Pat. No. 4,348,569. The stator has a single, fixed stop, which is disposed between the stops of a selected pair of a plurality of pairs of stops on the rotor. Selected stops are removed from the rotor so as to vary the arcuate spacing of the selected pair of stops, thereby to vary the degree of rotational freedom of the rotor. The switch can have from two to twelve index positions, each corresponding to a pair of detents, which cooperate with a pair of index bumps formed on a flexible rim of the rotor. The switch is convertible from a configuration wherein the switch has a lower number of index positions, as few as two, into a configuration wherein the switch has a higher number of index positions, as many as twelve, but not vice-versa.

Greater versatility in a rotary switch of the type noted above has been desirable. Heretofore, such a switch has not been available which was convertible from being operable over a smaller range of angular motion into being operable in either of two configurations over larger ranges of angular motion.

SUMMARY OF THE INVENTION

It is a principal object of this invention to provide a rotary switch which is convertible from being operable in over a smaller range of angular motion into being operable in either of two configurations over larger ranges of angular motion. Before its conversion according to this invention, the switch can be thus configured, as an example, as a two-position switch. After its conversion according to this invention, the switch can be thus configured, as an example, as a three-position switch, which can have either of two different modes of circuit-controlling operation, and which can have, in one such mode, one position being a momentary position. Overall, therefore, the same switch can have at least three different modes of circuit-controlling operation.

Broadly, a rotary switch according to this invention comprises a rotor and a stator assembled for relative rotation about an axis.

One of the rotor and the stator, preferably on the stator, is provided with four lugs arrayed circumferentially about the axis in regularly spaced relation to each other. The lugs define four quadrants, which may be respectively called first, second, third and fourth quadrants. Each quadrant is bounded by two lugs.

The other of the rotor and the stator, preferably the rotor, is provided with two pairs of lugs arrayed circumferentially about the axis in diametric opposition to each other. The lugs in each pair are in more closely spaced relation to each other and in less closely spaced relation to the other lugs on the same face. One of the lugs of each pair is removable. The removable lugs are in diametric opposition to each other, as are the other lugs of the pairs. In a preferred form, the removable lugs are wider, in an angular sense, than the other lugs of the pairs.

The rotor and the stator are assembled such that relative rotation of the rotor and the stator is limited by interference between certain of the lugs on the rotor and certain of the lugs on the stator.

Before removal of any of the removable lugs, the switch may be selectively configured in a configuration wherein the switch is operable over a smaller range of angular motion. In such configuration, the respective pairs of lugs move angularly within the first and third quadrants respectively. Thus, as an example, the switch may be selectively configured as a two-position switch.

Removal of the removable lugs of each pair enables the switch to be selectively configured in either of two configurations wherein the switch is operable over larger ranges of angular motion. In one such configuration, the remaining lugs of what had been the respective pairs move angularly within the first and third quadrants respectively. In the other such configuration, the same lugs move angularly within the second and fourth quadrants respectively. Thus, as an example, the switch may be selectively configured as a three-position switch having either of two different modes of circuit-controlling operation. In one such mode, one position of the switch is a momentary position.

These and other objects, features, and advantages of this invention will be further explained in the following description of a preferred embodiment of this invention, with reference to the accompanying drawings.

DETAILED DESCRIPTION OF PREFERRED EMBODIMENT

Figure 1:
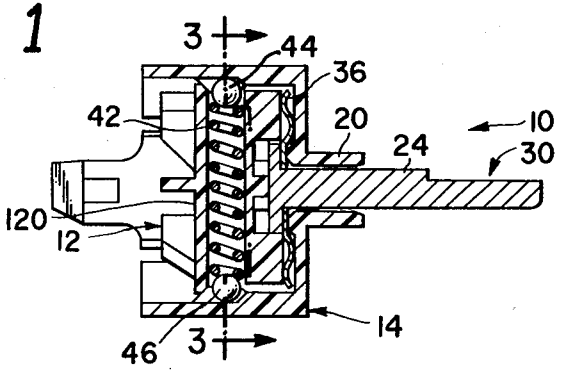
FIG. 1 is an enlarged, axial cross-sectional view of a rotor and stator assembly of a rotary switch constituting a preferred embodiment of this invention.
Figure 2:
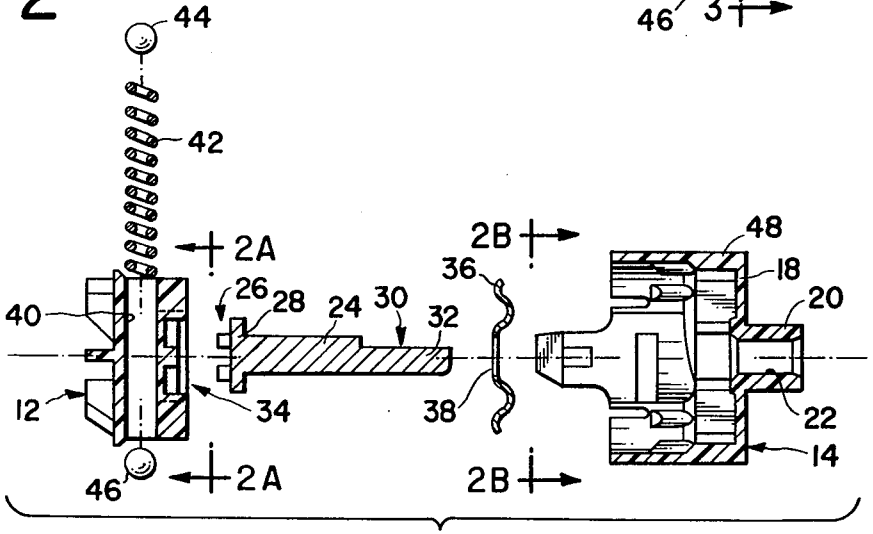
FIG. 2 is a slightly reduced, exploded view of the assembly shown in FIG. 1, as taken in axial cross section.
Figure 2B:
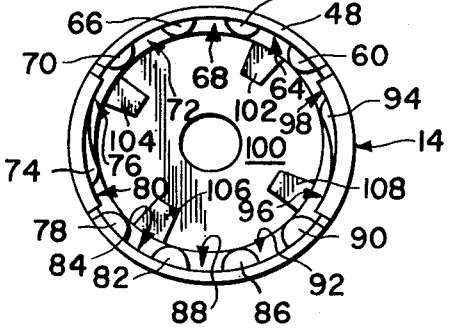
FIG. 2B is an axial view of one end of the stator, as taken along line 2B—2B in FIG. 2, in the direction of the arrows.
Figure 2A:
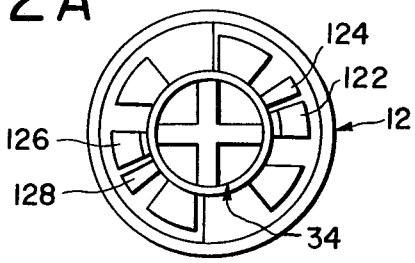
FIG. 2A is an axial view of one end of the rotor, as taken along line 2A—2A in FIG. 2, in the direction of the arrows.

As shown in the drawings, a rotary switch 10 comprises a rotor 12 and a stator 14, each being molded of a suitable plastic material. The rotor 12 and the stator 14 are assembled for relative rotation about an axis. The rotor 12 and the stator 14 carry electrical contacts (not shown) which are conventional features of rotary switches.

A unique aspect of this invention is that the switch 10 can be selectively assembled as a two-position switch, or, in either of two interchangeable positions, as a three-position switch. Once the switch 10 has been converted from a two-position switch into a three-position switch, the switch 10 cannot be converted back, unless the rotor 12 is replaced with an identical rotor having two removable lugs as well as two permanent lugs.

More particularly, the rotor 12 fits rotatably within the stator 14, which is cup-shaped, and which has an end wall 18 formed with an axial hub 20 having an axial bore 22. A shaft 24, which has a driving head 26 formed on one end portion 28 and a flat, elongated, axially extending key 30 formed on its other end portion 32, fits rotatably through the bore 22 of the hub 20 with its end portion 32 formed with the key 30 extending through the bore 22. The driving head 26 fits into a correspondingly shaped socket 34 formed on the rotor 12 so that the rotor 12 and the shaft 24 rotate conjointly. A finger washer 36 having a central aperture 38 fits around the shaft 24, between the driving head 26 and inner wall portions of the stator 14, so as to press the driving head 26 into the socket 34.

An actuating knob (not shown) or a keylock mechanism (not shown) may be operatively associated with the assembly 10 such that the shaft 24 may be manually rotated by a user. Typically, such a knob or keylock mechanism includes a keyway, into which the key 30 can be axially fitted. Such knobs and keylock mechansims are conventional features in rotary switches.

The rotor 12 is formed with a transverse bore 40, in which a coiled spring 42 is deployed. The spring 42 biases a pair of detent balls 44, 46 in radially outward and diametrically opposite directions. Alternatively, a separate coiled spring can be used to bias each ball. Other rolling elements may be used, in place of the balls 44, 46. As described below, the balls 44, 46 are seated removably in selected ones of detent pockets formed in the stator 14, upon rotation of the rotor 12 to different positions relative to the stator 14. Herein, detent means refers to such an arrangement of detent balls or other rolling elements being seated removably in detent pockets, as well as to equivalent arrangements.

A cylindrical wall 48 of the stator 14 is formed with a cylindrical array of detent pockets, each of which is defined by a pair of axial ribs formed in the stator 14. All of the ribs are equal in axial length. All but two of the ribs are spaced equally, in an angular sense, and are equal in angular width. All but two of the pockets are equal in angular width.

Specifically, a rib 60 and a rib 62 define a pocket 64, the rib 62 and a rib 66 define a pocket 68, and the rib 66 and a rib 70 define a pocket 72. The rib 70 and a rib 74, which has a very different shape for a function to be hereinafter described, define a pocket 76, which is much wider, in an angular sense, than the pockets 64, 68, 72. The rib 74 and a rib 78 define a pocket 80. Further, the rib 78 and a rib 82 define a pocket 84, the rib 82 and a rib 86 define a pocket 88, and the rib 86 and a rib 90 define a pocket 92. The rib 90 and a rib 94, which is shaped as the rib 74 is shaped for a like function, define a pocket 96, which is shaped as the pocket 76 is shaped. The rib 94 and the rib 60 define a pocket 98.

The end wall 18 of the stator 12 has an interior face 100 provided with four lugs 102, 104, 106, 108, which are equal in angular width, and which are arrayed circumferentially in regularly spaced relation to each other. Such lugs divide the face 100 into four quadrants, namely, into a first quadrant which is bounded by the lug 102 and the lug 104, a second quadrant, which is bounded by the lug 104 and the lug 106, a third quadrant, which is bounded by the lug 106 and the lug 108, and a fourth quadrant, which is bounded by the lug 108 and the lug 102. The lugs 102, 104, 106, 108 and the detent pockets into which the balls 44, 46 may be removably seated are displaced axially from each other so as to avoid interference between the lugs 102, 104, 106, 108 and the balls 44, 46. The washer 36 has four radial fingers extending between the lugs 102, 104, between the lugs 104, 106, between the lugs 106, 108, and between the lugs 108, 102, respectively.

An end face 120 of the rotor 12 is provided with a removable lug 122 and a permanent lug 124, which constitute a first pair, and with a removable lug 126 and a permanent lug 128, which constitute a second pair. The first and second pairs of such removable and permanent lugs are in diametric opposition to each other with the removable lugs 122, 126 in diametric opposition to each other and with the permanent lugs 124, 128 in diametric opposition to each other. The removable lugs 122, 126 are wider, in an angular sense, than the permanent lugs 124, 128. The lugs of each pair are separated from each other by only a few degrees, in an angular sense, so as to be substantially closer to each other than to the lugs of the other pair. Preferably, the rotor 12 is molded such that the removable lugs 122, 126 may be cleanly snapped off, as by means of a pair of needle-nosed pliers (not shown).

The differently shaped ribs 74, 94 have functions which will be better understood after a description has been given of each of several configurations into which the rotor 12 and the stator 14 can be selectively assembled.

Figure 4:
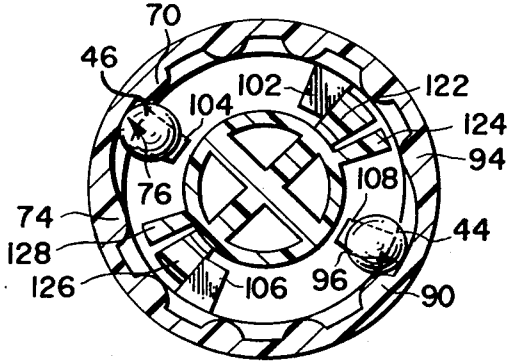
FIG. 4 is a like view of the assembly, as shown in FIG. 3, but with the rotor in a changed position relative to the stator.
Figure 3:
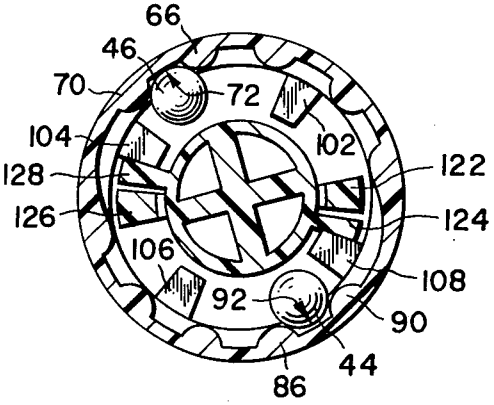
FIG. 3 is a slightly enlarged, cross-sectional view of the assembly in one configuration for a two-position switch, as taken along line 3—3 of FIG. 1, in the direction of the arrows.
Figure 7:
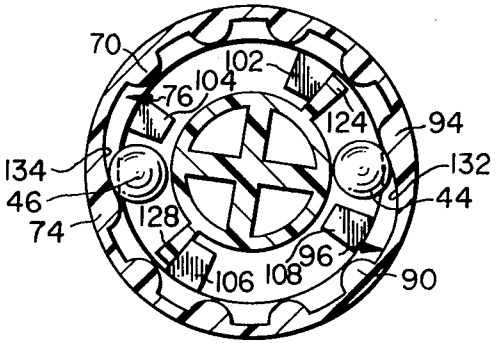
FIGS. 6 and 7 are like views of the assembly, as shown in FIG. 5, but with the rotor in changed positions relative to the stator.
Figure 10:
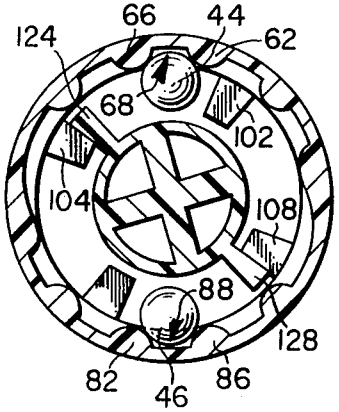
FIGS. 9 and 10 are like views of the assembly, as shown in FIG. 8, but with the rotor in changed positions relative to the stator.
Figure 9:
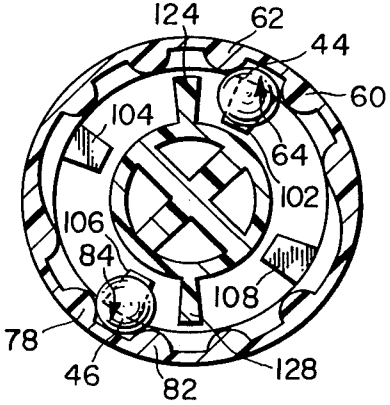
Figure 8:
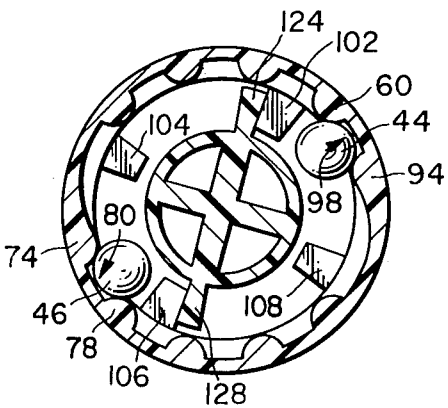
FIG. 8 is a similar cross-sectional view of the assembly in another configuration for a three-position switch.

As mentioned above, one of those configurations enables the switch 10 to serve as a two-position switch, as illustrated in FIGS. 3 and 4, whereas two other configurations enable the switch 10 to serve as a three-position switch having two different modes of circuit-controlling operation, as illustrated in FIGS. 7 through 9 and in FIGS. 10 through 12 respectively.

In the configuration illustrated in FIGS. 3 and 4, the rotor 12 is fitted rotatably into the stator 14 with the face 120 of the rotor 12 and the face 100 of the stator 14 juxtaposed such that the lugs 122, 124 on the rotor 12 move, in angular sense, between the lugs 102, 104 bounding the first quadrant. Consequently, the lugs 126, 128 on the rotor 12 move, in an angular sense, between the lugs 106, 108 bounding the third quadrant. In the configuration of FIGS. 3 and 4, as compared to the other configurations described below, the rotor 12 has a smaller range of angular motion.

In FIG. 3, the rotor 12 is shown in one of its two positions, which are defined by detent pockets receiving the balls 44, 46. As shown in FIG. 3, the ball 44 is seated removably in the pocket 92 and the ball 46 is seated removably in the pocket 72. FIG. 4 shows the rotor 12 in its other such position wherein the balls 44, 46 are seated removably in the pockets 96, 76.

The rotor 12 may be rotated between the position of FIG. 3 and the position of FIG. 4. Rotation of the rotor 12 is limited in a counterclockwise sense (as shown in FIG. 4) by interference between the lug 122 on the rotor 12 and the lug 102 on the stator 14 and between the lug 126 on the rotor 12 and the lug 106 on the stator 14. Rotation of the rotor 12 is limited in a clockwise sense (as shown in FIG. 3) by interference between the lug 124 on the rotor 12 and the lug 108 on the stator 14 and between the lug 128 on the rotor 12 and the lug 104 on the stator 14.

In an alternative embodiment (not shown) the switch 10 could be also configured, as a two-position switch, with the lugs on the rotor 12 moving, in an angular sense, in the first and third quadrants, as compared to the second and fourth quadrants.

Figure 6:
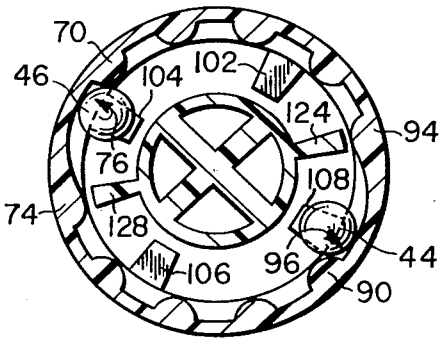
Figure 5:
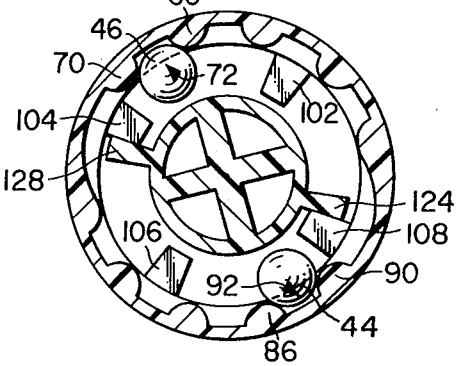
FIG. 5 is a similar cross-sectional view of the assembly in one configuration for a three-position switch.

In the configuration illustrated in FIGS. 5 through 7, as compared to the configuration illustrated in FIGS. 3 and 4, the removable lugs 122, 126 have been removed. FIGS. 5 throuqh 7 show the rotor 12 fitted rotatably into the stator 12 with the face 120 of the rotor 12 and the face 100 of the stator 14 juxtaposed such that the lug 124 on the rotor 12 moves, in an angular sense, between the lugs 108, 102 bounding the fourth quadrant. Consequently, the lug 128 on the rotor 12 moves, in an angular sense, between the lugs 104, 106 bounding the second quadrant. In the configuration of FIGS. 5 through 7, as compared to the configuration of FIGS. 3 and 4, the rotor 12 has a larger range of angular motion.

In FIG. 5, the rotor 12 is shown in one of its three positions, two of which are defined by detent pockets receiving the balls 44, 46, and one of which is a momentary position. As shown in FIG. 5, the ball 44 is seated removably in the pocket 92 and the ball 46 is seated removably in the pocket 72. FIG. 6 shows the rotor 12 in another such position with the ball 44 seated removably in the pocket 96 and the ball 46 seated removably in the pocket 76. FIG. 7 shows the rotor 12 in its momentary position with the ball 44 engaging a lateral cam surface 132, which is gradually curved from the rib 94 into the pocket 96, and with the ball 46 engaging a lateral cam surface 134, which is gradually curved from the rib 74 into the pocket 76. As biased by the spring 42, the balls 44, 46 will roll along the cam surfaces 132, 134, more deeply into the pockets 96, 76, so as to return the rotor 12 to the position of FIG. 6, if the rotor 12 is released.

Hence, the position of FIG. 7 is a momentary position, which enables the switch 10 to advantageously be used, in one example, as a starting switch for a lawn mower powered by a gasoline engine but started by an electric motor. Other examples of its advantageous use will be readily apparent.

The rotor 12 may be rotated from the position of FIG. 5 into the position of FIG. 6, and vice-versa, and from the position of FIG. 6 into the position of FIG. 7, and vice-versa. Rotation of the rotor 12 is limited in a counterclockwise sense (as shown in FIG. 7) by interference between the lug 124 on the rotor 12 and the lug 102 on the stator and between the lug 128 on the rotor 12 and the lug 106 on the stator 14. Rotation of the rotor 12 is limited in a clockwise sense (as shown in FIG. 5) by interference between the lug 124 on the rotor 12 and the lug 108 on the stator 14 and between the lug 128 on the rotor 12 and the lug 104 on the stator 14.

In the configuration illustrated in FIGS. 8 through 10, as compared to the configuration illustrated in FIGS. 5 through 7, the rotor 12 had been rotated by about one-quarter turn (90°) before the rotor 12 and the stator 14 were assembled. FIGS. 8 through 10 show the rotor with the face 120 of the rotor 12 and the face 100 of the stator 14 juxtaposed such that the lug 124 on the rotor 12 moves, in an angular sense, between the lugs 102, 104 bounding the first quadrant. Consequently, the lug 128 on the rotor 12 moves, in an angular sense, between the lugs 106, 108 bounding the third quadrant. In the configuration of FIGS. 8 through 10, as compared to the configuration of FIGS. 3 and 4, the rotor 12 has a larger range of angular motion, which is similar to its range of angular motion in the configuration of FIGS. 5 through 7.

In FIG. 8, the rotor 12 is shown in one of its three positions, which are defined by detent pockets receiving the balls 44, 46. As shown in FIG. 8, the ball 44 is seated removably in the pocket 98 and the ball 46 is seated removably in the pocket 80. FIG. 9 shows the rotor 12 in another such position with the ball 44 seated removably in the pocket 64 and the ball 46 seated removably in the pocket 84. FIG. 10 shows the rotor 12 in its other such position with the ball 44 seated removably in the pocket 68 and with the ball 46 seated removably in the pocket 88.

The rotor 12 may be rotated from the position of FIG. 8 into the position of FIG. 9, and vice-versa, and from the position of FIG. 9 into the position of FIG. 10, and vice-versa. Rotation of the rotor 12 is limited in a counterclockwise sense (as shown in FIG. 10) by interference between the lug 124 on the rotor 12 and the lug 104 on the stator 14 and between the lug 128 on the rotor 12 and the lug 108 on the stator 14. Rotation of the rotor 12 is limited in a clockwise sense (as shown in FIG. 8) by interference between the lug 124 on the rotor 12 and the lug 102 on the stator 14 and between the lug 128 on the rotor 12 and the lug 106 on the stator 14.

In some respects, the configuration of FIGS. 3 and 4 is analogous to the configuration of FIGS. 5 through 7. However, the switch 10 is a two-position switch in the configuration of FIGS. 3 and 4, whereas the switch 10 is a three-position switch in the configuration of FIGS. 5 through 7, one of the three positions being a momentary position.

It can be readily appreciated that the switch 10 is a highly versatile, modular switch, which can be readily converted from being operable over a smaller range of angular motion into being operable in either of two configurations over larger ranges of angular motion. When configured for a smaller range of angular motion, the switch 10 can be advantageously used as a two-position switch. When configured for larger ranges of angular motion, the switch 10 can be advantageously used as a three-position switch, one of the three positions being a momentary position.

In each of the several configurations of the switch 10, the rotor 12 may be also inverted by 90° within the stator 14, because of rotational symmetries of the rotor 12 and the stator 14. With different arrangements of electrical contacts (not shown) being provided on the rotor 12 and the stator 14 in each inverted relationship, the switch 10 can be thus provided with even greater versatility.

It is intended, by the following claims, to cover such modifications and improvements as come within the true spirit of this invention.

I claim:

1. A rotary switch, which is convertible from being operable over a small range of angular motion into being operable in either of two configurations over large ranges of angular motion, comprising a rotor and a stator assembled in a selected one of said configurations for relative rotation about an axis, one of the rotor and the stator being provided with four lugs arrayed circumferentially about the axis in regularly spaced relation to each other so as to form quadrants with each quadrant being bounded by two of said lugs, the other of the rotor and the stator being formed with two pairs of lugs, each pair consisting of a permanent lug and a removable lug, the permanent lugs being in diametric opposition to each other and the removable lugs being in diametric opposition to each other, the lugs of each pair being closer in angular relation to each other than to the lugs of the other pair, the rotor and the stator being assembled so that relative rotation of the rotor and the stator is limited by interference between certain of the lugs bounding the quadrants and certain of the lugs of said pairs, relative rotation of the rotor and the stator being permitted over a smaller range of angular motion when the removable lugs have not been removed but over larger ranges of angular motion when the removable lugs have been removed.

2. The rotary switch of claim 1 wherein the removable lugs are wider, in an angular sense, than the permanent lugs.

3. The rotary switch of claim 2 wherein one of the rotor and the stator has a circumferential array of pockets and the other of the rotor and the stator comprises detent means adapted to be removably seated in selected ones of said pockets upon relative rotation of the rotor and the stator to different angular positions relative to each other.

4. The rotary switch of claim 3 wherein said detent means comprises a rolling element, which is adapted to be removably seated in selected ones of said pockets upon relative movement of the rotor and stator to different angular positions relative to each other, and means for biasing the rolling element in a radial direction so as to urge the rolling element into selected ones of said pockets.

5. The rotary switch of claim 4 wherein at least one of the pockets has a lateral cam surface being gradually curved such that the rolling element tends to roll along said cam surface, more deeply into the pocket having said lateral surface.

6. The rotary switch of claim 5 wherein the rotor has the removable and permanent lugs and wherein the stator has the pockets.

7. The rotary switch of claim 3 wherein said detent means comprised a pair of rolling elements in diametric opposition to each other and means for biasing the rolling elements in radial directions so as to urge the rolling elements into selected ones of said pockets.

8. The rotary switch of claim 7 wherein two of the pockets in diametric opposition to each other have lateral cam surfaces being gradually curved such that the rolling elements tend to roll along said cam surfaces, more deeply into the pockets having said cam surfaces.

9. The rotary switch of claim 8 wherein the rotor has the removable and permanent lugs and wherein the stator has the pockets.

10. The rotary switch of claim 9 wherein the small range of angular motion in one of the configurations of the switch embraces a set of two of said pockets and wherein the large range of angular motion in another of the configurations of the switch embraces a set of three of said pockets and including one of the pockets having said cam surfaces.

11. The rotary switch of claim 10 wherein the large range of angular motion in another of the configurations of the switch embraces a set of three of said pockets but not including any pocket having such a cam surface.

* * * * *